US006216503B1

(12) United States Patent
Kitajima et al.

(10) Patent No.: US 6,216,503 B1
(45) Date of Patent: Apr. 17, 2001

(54) METHOD FOR SETTING OPERATING CONDITIONS FOR CONTINUOUS HOT ROLLING FACILITIES

(75) Inventors: Hiroaki Kitajima; Shigeo Takemoto, both of Chiba (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/599,959

(22) Filed: Jun. 23, 2000

(51) Int. Cl.[7] ..... B21B 37/16

(52) U.S. Cl. ..... 72/7.2; 72/8.3; 72/11.2; 72/365.2

(58) Field of Search ..... 72/7.1, 7.2, 8.1, 72/8.3, 9.1, 11.1, 11.2, 11.7, 365.2

(56) References Cited

U.S. PATENT DOCUMENTS 5,502,992 * 4/1996 Sorgel et al. ..... 72/9.1
5,609,053 * 3/1997 Ferreira et al. ..... 72/11.8
5,960,657 * 10/1999 Anbe et al. ..... 72/9.1

FOREIGN PATENT DOCUMENTS 6-297018 10/1994 (JP) .

* cited by examiner

*Primary Examiner*—Ed Tolan
(74) *Attorney, Agent, or Firm*—Oliff & Berridge, PLC

(57) ABSTRACT

A continuous hot rolling method includes setting operating conditions (OC) for hot rolling facilities, regarding rolled material for which endless rolling was planned, in which a preceding piece of material and a subsequent piece of material are joined to each other, to batch rolling, in which rolling is performed without joining the preceding piece of material and subsequent piece of material to each other, or setting of changes from batch rolling to endless rolling. Changes can be speedily and accurately made, so that operating problems, or defective coils due to inaccurate changes in settings or delays in changing the settings can be prevented. Both the operating conditions (OCIe) for endless rolling and the operating conditions (OCIb) for batch rolling are predetermined, and the operating conditions (OCe,OCb) for the facilities at various positions on the hot rolling line are determined for both endless rolling and for batch rolling.

9 Claims, 5 Drawing Sheets

FIG. 1

| | | |
|---|---|---|
| PRODUCT INFORMATION REGARDING MATERIAL TO BE ROLLED (PI) | | SLAB THICKNESS |
| | | SLAB WIDTH |
| | | HOT ROLLING COMMAND THICKNESS |
| | | HOT ROLLING COMMAND WIDTH |
| | | SPECIFICATIONS |
| | | ⋮ |
| OPERATING CONDITIONS FOR INITIAL FACILITY SETTINGS (OCI) | ENDLESS ROLLING (OCIe) | TENSION BETWEEN FINISHING STANDS |
| | | COILING TENSION |
| | | ROLLING SPEED |
| | | ⋮ |
| | BATCH ROLLING (OCIb) | TENSION BETWEEN FINISHING STANDS |
| | | COILING TENSION |
| | | ROLLING SPEED |
| | | ⋮ |

METHOD FOR SETTING OPERATING CONDITIONS FOR CONTINUOUS HOT ROLLING FACILITIES

BACKGROUND OF THE INVENTION

1. Field of Invention

This invention relates to a hot rolling method in which finish rolling is continuously performed. This invention particularly relates to a method for setting operating conditions for hot rolling facilities, which is capable of speedily and accurately performing setting changes regarding rolled material for which was planned endless rolling, wherein a preceding piece of material and a subsequent piece of material are joined each other at the entering side of a finishing mill, to batch rolling, wherein rolling is performed without joining the preceding piece of material and subsequent piece of material, or performing setting changes from batch rolling to endless rolling.

2. Description of Related Art

Conventionally, in hot rolling process, slabs are heated in a reheating furnace, and the slab extracted form the reheating furnace is subjected to rough rolling, and then finish rolling is performed for each roughed sheet bar, i.e., a batch rolling operation has been performed to manufacture steel strips, such as thin articles. However, in recent years, so-called endless rolling operation has been performed to manufacture steel strips, such as thin articles. In these operations, the tail end (rolled) of a preceding material is joined to the head end (rolled) of a subsequent material between a roughing mill and finishing mill, which is repeatedly performed so as to continuously perform finish rolling of the preceding material and the subsequent material.

FIG. 4 schematically shows an apparatus 10 for endless rolling. During the endless rolling operation, the tail end 12 of the preceding (downstream) material 14 and the head end 16 of the subsequent (upstream) material 18 are joined to each other at a sheet bar joining machine 30 provided between a 3-stand roughing mill 20, for example, and a 7-stand finishing mill 40, for example, so that finish rolling is continuously performed with the preceding material 14 and the subsequent material 18 being joined. A strip shear 50 for cutting the rolled material is provided downstream from the finishing mill 40, and multiple coilers 60 (two are shown) are provided downstream from the strip shear 50, so that the rolled material is subjected to finish rolling in the state in which the preceding material 14 and the subsequent material 18 are joined and is cut by the strip shear 50 into lengths which the coilers 60 can take up, with the rolled material preceding the cutting point, and the rolled material following the cutting point, being taken up on separate respective coilers.

Continuous finish rolling can be performed in the state in which the preceding material 14 and the subsequent material 18 are joined to each other by such an endless rolling operation, so there are no inconsistent portions at the head and tail ends in the finish rolling of individual sheet bars as with batch rolling, and stable rolling can be performed over the entire length of the rolled material. Thus, this arrangement is suitable for the rolling of rolled material for which the passage of inconsistent portions is difficult, such as with thin articles.

Operation condition (OC) settings for the facilities within such a hot rolling line are made by computer, as shown in FIG. 5. That is, for each slab (material to be rolled), product information (PI) (slab thickness, slab width, product thickness, product width, specifications, etc.) are inputted to an on-line computer 70, the on-line computer 70 sets the operating conditions (OCI) (tension between stands in the finishing mill, coiling tension, rolling speed, rolling temperature, draft schedule, conditions for cooling rolled material, etc.) for initial settings for the hot rolling facilities based on the slab information, and these operating conditions (OCI) for initial settings are sent to a process computer 72. Once the slab is placed on the rolling line, the process computer 72. Once the slab is placed on the rolling line, the process computer 72 reads in rolled material information (IRM), such as detection values (temperature, plate thickness, plate width, etc.) from detectors positioned at various locations on the rolling line. In FIG. 5, these detectors are the detector 24 at the exit side of the roughing mill 20, the detector 32 at the exit side of the sheet bar joining machine 30, and the detector 44 at the exit side of the finishing mill 40. The process computer 72 also reads in actual operating data, including the rolling load at the drafting devices 22 of the roughing mill 20 and at the drafting devices 42 of the finishing mill 40, of the facilities for continuous hot rolling. In the embodiment shown in FIG. 5, these facilities include the roughing mill 20, sheet bar joining machine 30, finishing mill 40, strip shear 50 and coiler 60. The process computer 72 calculates the operating conditions (OC) for the facilities downstream from the current position of the rolled material, so that the rolled material is rolled to the product specifications provided to the on-line computer 70, based on such rolled material information. Then, operating conditions signals based on the calculation results are sent to the facilities, thereby running these facilities.

For example, for batch rolling operations, the calculation of the operating conditions (OC) of the finishing mill 40 by the process computer 72 is performed as follows. At the stage that the rough rolling is completed at the roughing mill 20, the rolled material information (IRM) relating to the dimensions and temperature of the roughed sheet bar is detected by the detector 24 at the exit side of the roughing mill 20, or is calculated based on the actual operating data from the roughing mill 20, and operating conditions (OC) for the finishing mill 40 (load for each stand, mill gaps, circumferential speed for the reduction rollers, etc.) such that the finish rolling is executed under the finishing operating conditions (OC) sent from the on-line computer 70, based on the rolled material information.

On the other hand, in the endless rolling operation, the process computer 72 calculates the operating conditions (OC) for the finishing mill 40 regarding the subsequent material 18, after the preceding material 14 is joined to the subsequent material 18 at the sheet bar joining machine 30.

However, in some cases, rolled material for which endless rolling was planned must be switched to batch rolling, due to reasons such as operating problems occurring, e.g., malfunctioning of the sheet bar joining machine 30.

In this case, the operating conditions (OC) settings for the finishing mill 40 regarding the rolled material for which endless rolling was initially planned are based on the operating conditions (OC) provided from the on-line computer 70 assuming that endless rolling is to be performed. Accordingly, in the event that batch rolling is performed with the setting values for the operating conditions (OC) for endless rolling maintained as they are, the target product dimensions cannot be attained. Accordingly, in the event of performing batch rolling for rolled material for which endless rolling was initially planned, the operating conditions (OC) for the finishing mill have been manually changed by the operator to carryout the batch rolling.

However, when such setting changes in operating conditions (OC) are made by manually, not only are the operations extremely complicated, they must also be carried out in the short time period between the tail end 12 of the preceding material 14 completely passing through the finishing mill 40, and the finishing mill 40 biting the head end 16 of the subsequent material 18. Accordingly, there have been problems, such as changes in the settings of the operating conditions (OC) not being made accurately, or not being made in time, resulting in operating problems, or in not attaining the target rolled product dimensions, and consequently producing defective coils.

Japanese Unexamined Patent Publication No. 6-297018 discloses an arrangement in which material fracture detection is performed for the connection of materials when performing continuous hot rolling, and based on the detection of material fracture, the transport speed of the material upstream of the fracture point is temporarily reduced so as to create a spacing between the material upstream of the fracture point and the material downstream of the fracture point, and the settings for the finishing mill are switched from the endless rolling setting method to the batch rolling setting method, thereby eliminating miss rolling at the time of biting with the finishing mill. However, this Publication does not disclose any method for switching from endless rolling to batch rolling in the event that some sort of anomaly occurs before, or at the time of, joining the materials.

The above description pertains to problems regarding the finishing mill 40 in switching material to be rolled, for which endless rolling had been planned, to batch rolling. However, there are similar problems for facilities other than the finishing mill 40, such as the rolled material cooling equipment (not shown) or coilers 60, for example, provided downstream from the finishing mill 40.

SUMMARY OF THE INVENTION

This invention has been made in order to solve the above-described conventional problems. It is an object of this invention to speedily and accurately perform setting changes for the operating conditions of the facilities for hot rolling, regarding changing rolled material, for which endless rolling had been planned, from endless rolling to batch rolling, or regarding changing rolled material, for which batch rolling had been planned, from batch rolling to endless rolling.

This invention solves the above-described problems by providing a method for setting operating conditions (OC) for hot rolling material, in which product information (PI) for the material to be rolled (specifications for the material to be rolled, slab dimensions, product thickness, product width, etc.) is inputted, the operating conditions (OCI) for initial settings of the facilities for each material to be rolled are predetermined based on the product information (PI) for the material to be rolled, then the material to be rolled is placed on the hot rolling line, information (IRM) of the rolled material being rolled, such as thickness, width, temperature, etc., is detected at various positions on the hot rolling line, and operating conditions (OC) of facilities downstream from the position at which the information (IRM) for the rolled material is detected are calculated based on the information detection values of the rolled material and the operating conditions (OCI) for the initial settings. Both the operating conditions (OCe) for endless rolling, and the operating conditions (OCb) for batch rolling, in which rolling is performed without joining a preceding material and a subsequent material to each other, are predetermined, and sent to a device, such as, for example, an on-line computer.

According to this invention, both the operating conditions (OCIe) for the initial settings for endless rolling and the operating conditions (OCIb) for the initial settings for batch rolling, regarding a material to be rolled for which endless rolling was planned, e.g., a slab, are determined by a device, such as, for example, an on-line computer. Then, if execution of endless rolling becomes impossible, a device, such as a process computer, for example, calculates the operating conditions (OCb) for batch rolling for the facilities, based on the already-determined operating conditions (OCIb) for the initial settings for batch rolling. Accordingly, even if the plans for endless rolling need to be suddenly changed to batch rolling, there is no need for manually changing the settings of the operating conditions. Consequently, complicated tasks associated with the setting changes of the operating conditions are eliminated, and also operating problems and defective coils, which are related to mistakes and delays in changing settings, can be prevented.

Further, according to this invention, calculations for the operating conditions (OC) for the facilities are performed regarding both operating conditions (OCe) for endless rolling based on the information (IRM) of the rolled material and the operating conditions (OCIe) for the initial settings for endless rolling, and operating conditions (OCb) for batch rolling based on the information (IRM) of the rolled material and the operating conditions (OCIb) for the initial settings for batch rolling.

In this case, both the operating conditions (OCIe) for the initial settings for endless rolling and the operating conditions (OCIb) for the initial settings for batch rolling, regarding a material to be rolled for which endless rolling was planned, e.g., a slab, are determined by the on-line computer, for example. Further, when the material being rolled reaches a certain position in the facilities on the rolling line, the process computer, for example, calculates both the operating conditions (OCe) for endless rolling and the operating conditions (OCb) for batch rolling, at the time of calculating the operating conditions (OC) for the facilities downstream of the certain position. In the event that endless rolling is to be performed as planned, the facilities are run under the operating conditions (OCe) for endless rolling. On the other hand, even in the event of switching from endless rolling to batch rolling, the already-calculated batch rolling operating conditions (OCb) are used, so that the operating conditions (OC) of the facilities can be switched to those for batch rolling in a short period of time.

Also, this invention is capable of setting operating conditions (OCe,OCb) for endless rolling or batch rolling regarding facilities upstream of the sheet bar joining machine (such as a reheating furnace or a roughing mill), so that switching between endless rolling and batch rolling can be carried out in a more flexible and smoother manner. In addition, the complicated operations of operator-based switching can be eliminated.

BRIEF DESCRIPTION OF THE DRAWINGS

FIG. 1 is an exemplary chart illustrating an example of records of an on-line computer used in an embodiment of this invention;

DETAILED DESCRIPTION OF PREFERRED EMBODIMENTS

Figure 5:
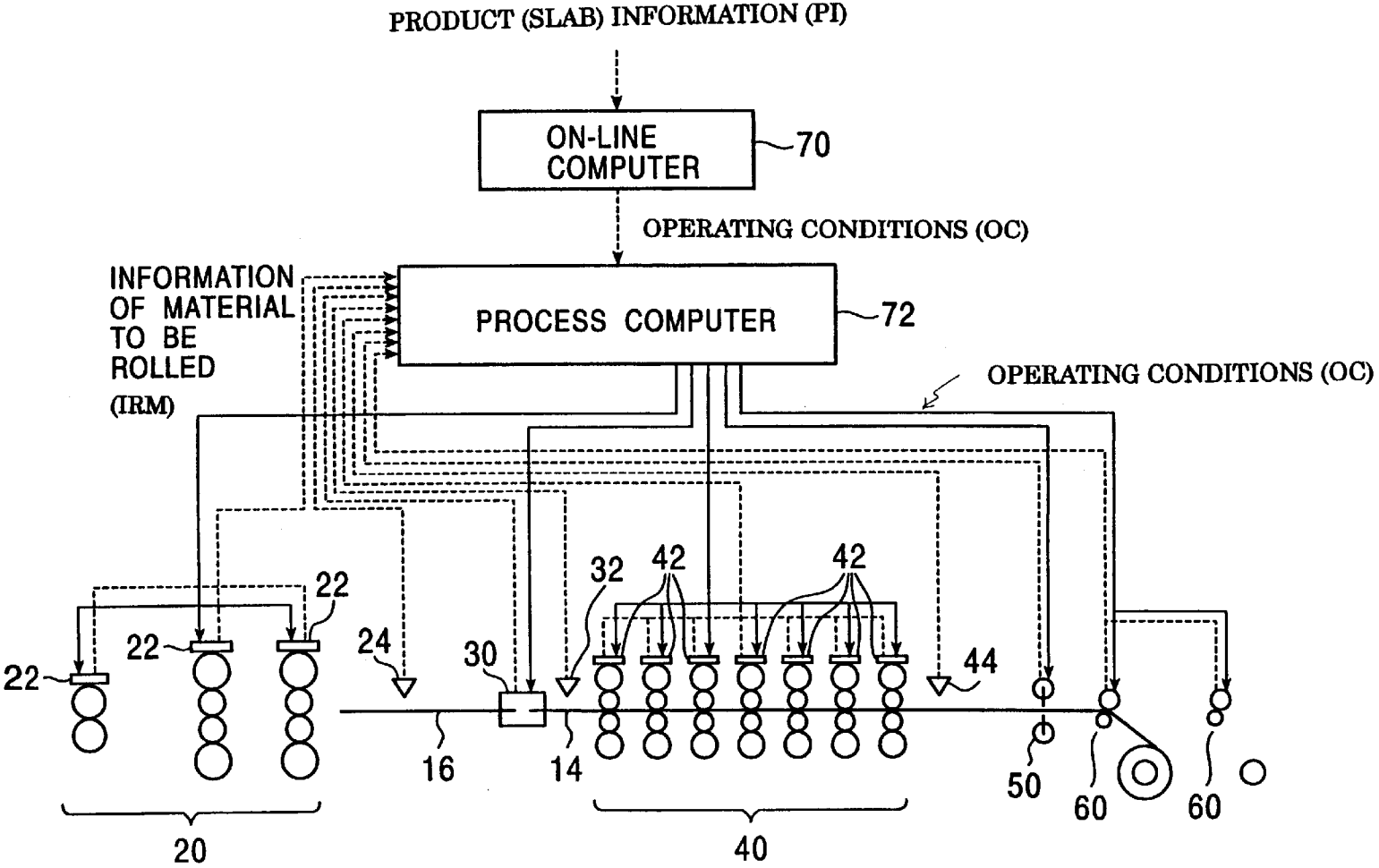
FIG. 5 is a block diagram illustrating the configuration of a control device to which this invention can be applied.

An embodiment of this invention applied to the control device shown in FIG. 5 will now be described in detail, with reference to the drawings. The embodiment of the invention is arranged such that the operating conditions (OCIe) for initial settings for the facilities for endless rolling, and the operating conditions (OCIb) for initial settings for the facilities for batch rolling, are set in the on-line computer 70, for all slabs. For example, as shown in FIG. 1, the operating conditions (OCIe) for the initial settings for the facilities for endless rolling and the operating conditions (OCIb) for the initial settings for the facilities for batch rolling can be provided in records in the on-line computer 70 for product information (PI). The product information (PI) can include, for example, slab thickness, slab width, hots rolling command thickness (product thickness following hot rolling), hot rolling command width (product width following hot rolling), and specifications. Operating conditions (OC) include, for example, settings for the tension between the stands of the finishing mill 40 (tension between finishing stands), settings for tension between the coilers 60 and the finishing mill 40 (coiling tension), rolling speed, and the like.

Figure 2:
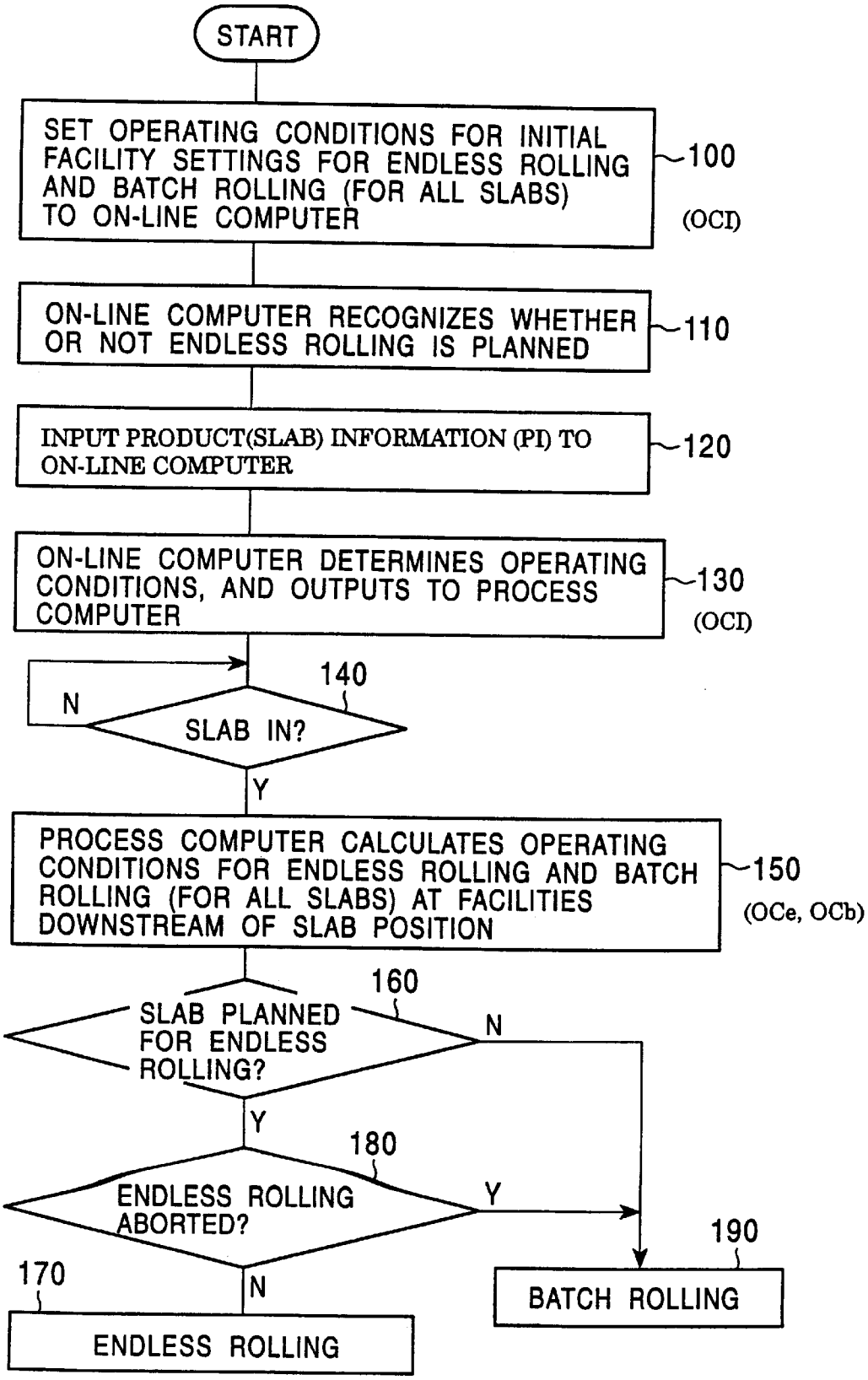
FIG. 2 is a flowchart illustrating the processing procedures for an embodiment of this invention.

Then, as shown in the processing procedures in FIG. 2, the operating conditions (OCIb) for initial settings for the facilities for batch rolling, and the operating conditions (OCIe) for initial settings for the facilities for endless rolling, are provided for all slabs (step 100). Also, regarding slabs for which endless rolling is planned, an endless rolling command is input to the on-line computer 70, so that the on-line computer 70 recognizes whether or not to perform endless rolling for each slab (step 110).

Next, once the product information (PI), such as slab dimensions, hot rolling command thickness, hot rolling command width, and specifications are input to the on-line computer 70 (step 120), the on-line computer 70 determines the operating conditions (OCI) for initial settings corresponding to the slab thickness, slab width, hot rolling command thickness, hot rolling command width, and specifications in the record, and sends the operating conditions to the process computer 72 (step 130).

After the slab is placed on the hot rolling line (step 140), the process computer 72 calculates the operating conditions (OC) of the facilities downstream from the current position of the rolled material, at each position along the hot rolling line (step 150). At this time, in the event that endless rolling is planned for the slab, both the operating conditions (OCIe) for the initial settings for facilities for endless rolling, and the operating conditions (OCIb) for the initial settings for facilities for batch rolling, have been sent from the on-line computer 70 to the process computer 72, so that the process computer 72 calculates the operating conditions (OCe,OCb) for both endless rolling and for batch rolling.

The following is a description of an exemplary embodiment of calculating the operating conditions (OCe) for finish rolling for material regarding which endless rolling is planned.

Regarding a slab for which the endless rolling command has been input to the on-line computer 70 (step 160), the process computer 72 calculates the operating conditions (OCe) of the sheet bar joining machine 30 following completion of rough rolling, and the sheet bar joining machine 30 joins the subsequent material to the preceding material under the above operating conditions. When the joining is completed, the process computer 72 calculates the operating conditions (OCe) of the finishing mill 40 for endless rolling, and the finishing mill 40 is operated under the operating conditions calculated at this point (step 170).

With this invention, the operating conditions (OCIb) for the initial settings for facilities for batch rolling have also been sent from the on-line computer 70 for material for which endless rolling is planned, so that calculations are also made for setting the operating conditions (OCb) of the finishing mill 40 if batch rolling is to be performed, based on the operating conditions (OCIb) for the initial settings for facilities for batch rolling and the rolled material information (IRM). Specifically, when rough rolling is completed, the process computer 72 makes calculations of settings for operating conditions (OCe) for performing endless rolling, wherein the sheet bar joining machine 30 is run, and following joining, the finishing mill 40 is run under the operating conditions (OCe) of endless rolling, and also makes calculations of settings for operating conditions (OCb) for performing batch rolling, in which the sheet bar joining machine 30 is not run, and the finishing mill 40 is run under the operating conditions (OCb) of batch rolling. Accordingly, even if endless rolling becomes impossible at any point before joining due to malfunctioning of the sheet bar joining machine 30 or the like, the operator or a sensor detecting the anomaly inputting an endless rolling abort signal to the process computer 72 (step 180) causes the process computer 72 to run the facilities downstream of the roughing mill based on the calculation results for the settings for the operating conditions for batch rolling, performed at the point that roughing milling was completed (step 190).

For endless rolling in general, articles for which batch rolling is difficult, such as articles with a thin hot rolling command thickness, are often rolled. Accordingly, in the event of changing from endless rolling to batch rolling, there are cases where the article cannot be manufactured at the hot rolling command thickness, which was planned for endless rolling. In such cases, a commonly-employed thickness changing function (a function wherein, in the event that the operator selects a thickness to change to, calculations are made for the operating conditions (OC) for automatically rolling to that thickness) can be used for the operator to change the hot rolling command thickness at the time of changing to batch rolling.

The above description pertains to an embodiment applied to calculations made at the time following roughing milling to starting finish rolling, i.e., calculating the operating conditions (OC) of the sheet bar joining machine 30 and finishing mill 40. However, this invention preferably can be applied to all facilities within the continuous hot rolling line and not only to the sheet bar joining machine 30 and finishing mill 40. For example, before performing rough rolling of the rolled material for which endless rolling is planned, both the operating conditions (OCe) of the roughing mill for endless rolling and the operating conditions (OCb) of the roughing mill for batch rolling are preferably calculated. Particularly, for facilities wherein the operating conditions (OCe,OCb) for endless rolling and for batch rolling differ greatly from each other, it is necessary to calculate the operating conditions (OCe,OCb) for both endless rolling and batch rolling.

Figure 3:
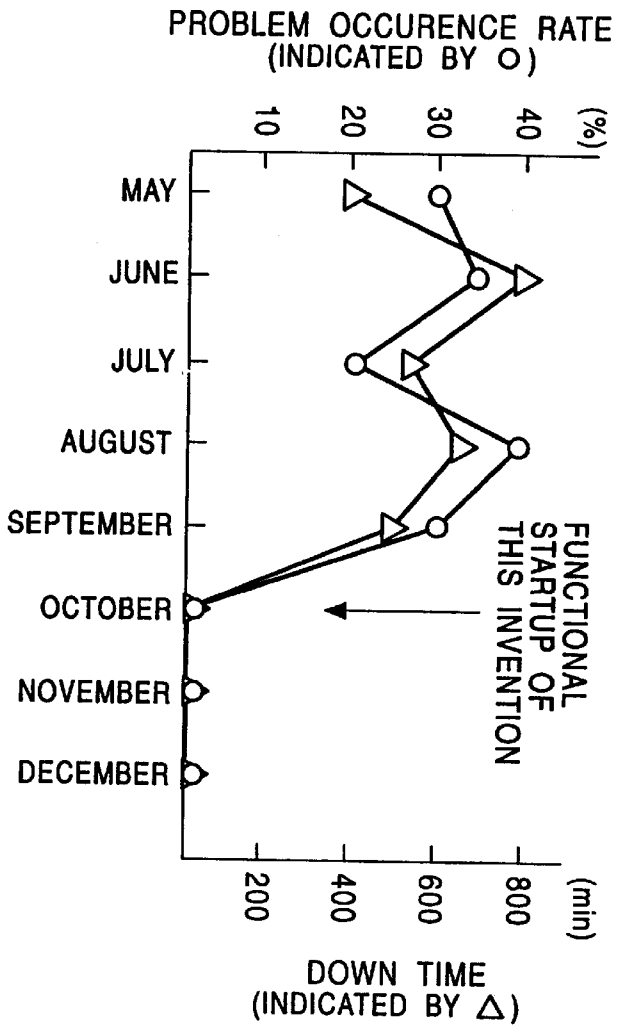
FIG. 3 is a chart illustrating the transitions in the rate of problems occurring and the related down time after carrying out this invention, with regard to an embodiment of this invention.
Figure 4:
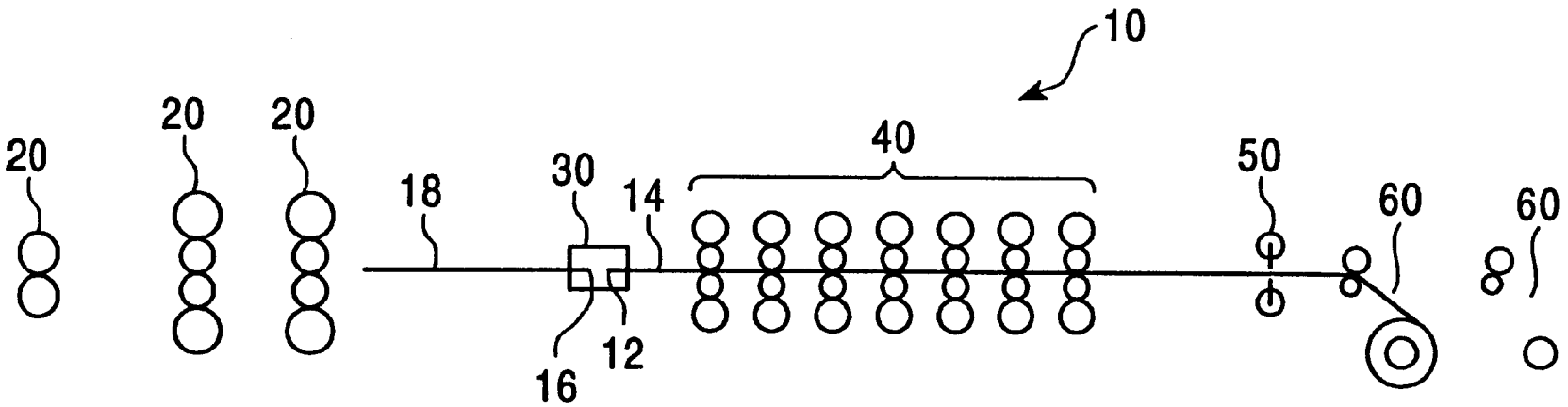
FIG. 4 illustrates an exemplary hot rolling line to which this invention can be applied.

FIG. 3 illustrates the transition of the rate of problems occurring at the time of aborting endless rolling (denoted by circles in the chart), and the down time (denoted by triangles). Here, the rate of occurrences of problems means the number of times that finish rolling could not be performed, or the process did not proceed to correct coiling due to deformations following finish rolling or other causes, as to the number of times that endless milling was aborted. Also, the down time means the amount of time that the rolling line was shut down due to problems accompanying aborting endless milling.

The method for setting operating conditions (OC) according to this invention (wherein, as described above, both the operating conditions (OCIe) for the initial settings for facilities for endless rolling and the operating conditions (OCIb) for the initial settings for facilities for batch rolling are determined by an on-line computer, and a process computer calculates both the operating conditions (OCe) for endless rolling and the operating conditions (OCb) for batch rolling when calculating the operating conditions (OC) for the facilities at various positions on the hot rolling line) was started up in October, and as can be clearly understood from FIG. 3, the occurrence of problems accompanying the abortion of endless rolling became practically non-existent following October, as well as the down time associated with such problems being eliminated.

Thus, setting changes can be speedily and accurately made for operating conditions (OC) for the facilities regarding rolled material, for which endless rolling was planned, from endless rolling to batch rolling, or from batch rolling to endless rolling, so that operating problems or defective coils due to inaccurate settings for the operating conditions (OC) for the facilities, or delays in changing the settings, can be prevented. This invention can also set operating conditions (OCe,OCb) for endless rolling or batch rolling for facilities upstream of the sheet bar joining machine (reheating furnace, roughing mill, etc.) as well, so that the operations of switching between endless rolling and batch rolling can be carried out in a more flexible and smoother manner. Also, the complicated operations of operator-based switching can be eliminated.

What is claimed is:

1. A method for setting operating conditions (OC) for continuous hot rolling facilities, in which preceding and subsequent materials can be joined to each other during rolling, the method comprising:

inputting product information (PI) for a material to be rolled;

predetermining the operating conditions (OCI) for initial settings of the facilities for each material to be rolled based on the product information (PI) for the material to be rolled;

then placing the material to be rolled on a hot rolling line;

detecting information (IRM) of the rolled material while being rolled at one or more positions on the hot rolling line; and determining the operating conditions (OC) of operating facilities downstream from the positions at which the information (IRM) for the rolled material are detected based on the detected information values of the rolled material and the operating conditions (OCI) for the initial settings;

wherein both (a) the operating conditions (OCIe) for the initial settings for endless rolling, in which preceding and subsequent materials are joined to each other during rolling, and (b) the operating conditions (OCIb) for initial settings for batch rolling, in which rolling is performed without joining between a preceding material and a subsequent material to each other, are predetermined.

2. The method for setting operating conditions (OC) for continuous hot rolling facilities according to claim 1, wherein calculations for both (a) the operating conditions (OCe) for endless rolling for the facilities are performed based on the information (IRM) for the rolled material and the operating conditions (OCIe) for the initial settings for endless rolling, and (b) the operating conditions (OCb) for batch rolling for the facilities are performed based on the information (IRM) for the rolled material and the operating conditions (OCIb) the initial settings for batch rolling.

3. The method for setting operating conditions (OC) for continuous hot rolling facilities according to claim 1, wherein the product information (PI) of the material to be rolled includes at least specifications of material to be rolled, slab dimensions, product thickness, and product width.

4. The method for setting operating conditions (OC) for continuous hot rolling facilities according to claim 1, wherein the rolled material information (IRM) includes at least the thickness of the rolled material, the width of the rolled material, and the temperature of the rolled material.

5. The method for setting operating conditions (OC) for continuous hot rolling facilities according to claim 1, wherein said downstream facilities include at least a slab reheating furnace, roughing mill, sheet bar joining machine, finishing mill, cooler, strip shear, and coiler.

6. A method for setting operating conditions (OC) for continuous hot rolling facilities, in which preceding and subsequent materials can be joined to each other during rolling, the method comprising:

(a) inputting product information (PI) for the material to be rolled;

(b) predetermining, for each material to be rolled, (i) the operating conditions (OCTe) for initial settings of the facilities for endless rolling, in which preceding and subsequent materials are joined to each other during rolling, and (ii) the operating conditions (OCIb) for initial settings of the facilities for batch rolling, in which preceding and subsequent materials are not connected to each other during rolling, based on the product information (PI) for the material to be rolled;

(c) subsequently placing the material to be rolled on the hot rolling line, and detecting information (IRM) of the rolled material while being rolled at selected positions on the hot rolling line;

(d) determining operating conditions (OC) of facilities downstream from the position at which the information (IRM) for the rolled material is detected based on the information detection values of the rolled material and the operating conditions (OCIe,OCIb) for said initial settings for endless rolling and batch rolling; and (e) setting the batch rolling operating conditions (OCb) to the downstream facilities in the event of switching from endless rolling to batch rolling partway through hot rolling, or setting the endless rolling operating conditions (OCe) to the downstream facilities in the event of switching from batch rolling to endless rolling.

7. The method for setting operating conditions (OC) for continuos hot rolling facilities according to claim 6, wherein the product information (PI) of the material to be rolled includes at least specifications of material to be rolled, slab dimensions, product thickness, and product width.

8. The method for setting operating conditions (OC) for continuous hot rolling facilities according to claim 6, wherein the rolled material information (IRM) includes at least the thickness of the rolled material, the width of the rolled material, and the temperature of the rolled material.

9. The method for seeing operating conditions (OC) of continuous hot rolling facilities according to claim 6, wherein the downstream facilities include at least a slab reheating furnace, roughing mill, sheet bar joining machine, finishing mill, cooler, strip shear, and coiler.

* * * * *